US006671979B2

(12) United States Patent
Cardarelli

(10) Patent No.: US 6,671,979 B2
(45) Date of Patent: Jan. 6, 2004

(54) AIR FLOW SHOE SYSTEM

(76) Inventor: Venanzio Cardarelli, 20 N. Triangle Dr., Plymouth, MA (US) 02360

( * ) Notice: Subject to any disclaimer, the term of this patent is extended or adjusted under 35 U.S.C. 154(b) by 104 days.

(21) Appl. No.: 10/061,785

(22) Filed: Feb. 1, 2002

(65) Prior Publication Data

US 2003/0145486 A1 Aug. 7, 2003

(51) Int. Cl.[7] ..... A43B 7/06; A43B 7/08; A43B 7/12; A43B 13/20

(52) U.S. Cl. ..... 36/3 B; 36/3 R; 36/29; 36/35 B

(58) Field of Search ..... 36/3 B, 3 R, 3 A, 36/29, 35 B, 141

(56) References Cited

U.S. PATENT DOCUMENTS

| | | | | | |
|---|---|---|---|---|---|
| 426,495 | A | * | 4/1890 | Falkner | 36/3 R |
| 592,822 | A | * | 11/1897 | Parker | 36/3 B |
| 896,488 | A | * | 8/1908 | Valiant | 36/3 B |
| 1,160,810 | A | * | 11/1915 | Abramowitz | 36/3 B |
| 1,260,942 | A | * | 3/1918 | Price et al. | 36/3 B |
| 1,317,161 | A | * | 9/1919 | Hay | 36/3 B |
| 1,493,341 | A | * | 5/1924 | Hansen | 36/3 R |
| 1,521,964 | A | * | 1/1925 | Menefee | 36/3 R |
| 4,860,463 | A | * | 8/1989 | Pin | 36/3 B |
| 5,675,914 | A | | 10/1997 | Cintron | |
| 5,813,140 | A | * | 9/1998 | Obeid | 36/3 R |
| 5,826,349 | A | * | 10/1998 | Goss | 36/3 R |
| 5,950,332 | A | | 9/1999 | Lain | |
| 5,979,086 | A | | 11/1999 | Vindriis | |
| 6,092,310 | A | | 7/2000 | Schoesler | |
| 6,158,149 | A | | 12/2000 | Rudy | |
| 6,460,197 | B2 | * | 10/2002 | Huang | 36/29 |

* cited by examiner

*Primary Examiner*—Anthony D. Stashick
(74) *Attorney, Agent, or Firm*—D. Michael Burns

(57) ABSTRACT

An air flow system based on the human circulatory system whereby a cushioning, cooling and circulating air flow is generated by a wearer of the shoe. The shoe includes a heart pump actuated by the wearer wherein arteries lead air throughout the shoe and veins return the air to the pump. The shoe is designed to free the foot of immobility and rigidity, to aid in development and maintenance of muscle groups required in function. The longitudinal arch that develops is formed by the wearer and is individualized for each wearer rather than being preformed in the shoe itself.

17 Claims, 4 Drawing Sheets

AIR FLOW SHOE SYSTEM

BACKGROUND OF THE INVENTION

1. Field of the Invention

The present invention relates generally to an air flow system designed to be used within a shoe or sock, and more specifically with an athletic shoe wherein the air flow is generated by the wearer of the shoe or sock.

2. Description of the Prior Art

The human circulatory system is the basis for this invention that incorporates human anatomy, physiology and kinesiology. The concepts as to how the foot should function within a shoe are discussed versus how civilized man has succeeded in immobilizing the system. The evolution of the foot from a flexible organ characterized by powerful extrinsic muscles into a comparative rigid mechanism designed for locomotion has been partially successful. The functional grasping muscles are still present but reduced in size and subordinated to the structural demands required in providing propulsive leverage. Most babies are flatfooted when they begin to walk. The short plantar muscles gradually tighten up, the anterior and posterior tibialis muscles lift the inner border and are the development of the longitudinal arch. No one type of arch is considered normal and its height and shape are of no value in estimating the strengths or usefulness of the foot. The weight during walking is transmitted to the heads of all metatarsal bones, hence there is no such thing as a transverse arch in a loaded foot.

There is a lack of agreement in regards to when a foot is "normal". The feet of primitive people who did not wear shoes were extremely mobile. They appear almost flat when weight in a relaxed state, but become highly arched in action. Such feet may tire easily under prolonged standing, but their functional capabilities are indicated by the fact that they are said to be frequently seen in runners and ballet dancers. The feet of most civilized men, however, are characterized by a pronounced longitudinal arch, which is not depressed during weight bearing nor raised during action. The static condition is attributed to the fact that modern shoes place the foot in a splint, the ligament shorten, the joint capsules contract, adhesion forms and the arch becomes relatively rigid.

The prior art addresses the use of fluid mediums in the construction of shoes. For purposes of simplicity, the type of shoe (sneaker, athletic etc.) will not be specifically cited. Many prior art patents utilize a fluid to cool the shoe, while others use fluids to cushion the pounding caused by walking and running. U.S. Pat. No. 6,092,310 issued to Schoesler on Jul. 25, 2000 discloses a fluid filled insole with flow passages matched to the anatomical structure of the foot. U.S. Pat. No. 5,979,086 issued to Vindriis on Nov. 9, 1999, teaches of an insole to provide relief of both shocks and also to provide a massaging effect.

A U.S. Pat. No. 5,675,914 issued to Cintron on Oct. 14, 1997, discloses a removable foot bed which circulates air and utilizes a pump activated by the user striking down on it with his heel. Another example of a shoe utilizing a pump to actuate the flow of a fluid therein is shown in the U.S. Pat. No. 5,950,332, issued to Lain on Sep. 14, 1999.

An article of footwear demonstrating multiple fluid containing devices is shown in the Rudy U.S. Pat. No. 6,158,149 issued on Dec. 12, 2000.

The present invention is designed to free the foot of immobility and rigidity. Designed to allow the foot to return to a relaxed state as well as allowing the formation of the longitudinal arch in an action state. Every person's arch is different yet today's shoes have a fixed arch support which in a way provide a mechanical support for a foot in a constant action state and not allowing for a relaxation phase. The present invention will provide the benefits of a primitive foot in function without the foot fatigue, which sets in a fixed, rigid, and immobile system. The present invention aids in the development and maintenance of muscle groups required in the act of walking and running. Evolutionary change is a demand change, we are interfering and altering evolution by changing the functional aspects of our osteo-ligamentous-muscular system. Instead of helping we are providing anatomical and physiological changes and with consequences of tired feet, knee problems, lower back problems, postural problems etc.

SUMMARY OF THE INVENTION

The foot is a very complex entity. The bones, ligaments, tendons and muscles working together with the leg muscles are a vital consideration in the design of the shoe of the present invention. The present invention is designed as to not limit these elements in function nor immobilize them. Accordingly, the above problems and difficulties are obviated by the present invention which provides for an air flow system in which the shoe does not provide a single arch support, but provides a system whereby each individual may have the ability to create his/her own arch support depending on the person's own shape, size and walking habits.

More particularly, the present invention is comprised of a design system based upon the function of the human heart. The system having a heart pump whereby arteries lead the air away from the pump to provide support for the foot and subsequently veins return the air.

An object of the present invention is to provide a shoe support system wherein the pumping action is controlled by the foot in motion.

Another object of the invention is to provide a system whereby each individual's own unique foot and stride create the arch support best for him.

Still another object of the present invention is to provide a shoe system based on a study of man's evolutionary approach to walking and running. The present invention's object being the creation of a shoe that would provide benefits to the user without foot fatigue which is created with a fixed, rigid and immobile system.

Yet another object of the invention is the pressure sensitive sieve plate located on the upper heel of the shoe, the plate providing air on demand to a closed and open system.

Still another object of the present invention is to provide a shoe wherein the volume and rate of air flow is dependent on the user.

Still another object of the present invention is to provide a cooling system for the feet.

Yet still another object of the present invention is to allow muscles, ligaments and bones the freedom of expression without restrictions, limitations in movement and function.

These and other objects will become readily apparent upon further review of the following specification and drawings.

DETAILED DESCRIPTION OF THE PREFERRED EMBODIMENT

Figure 1:
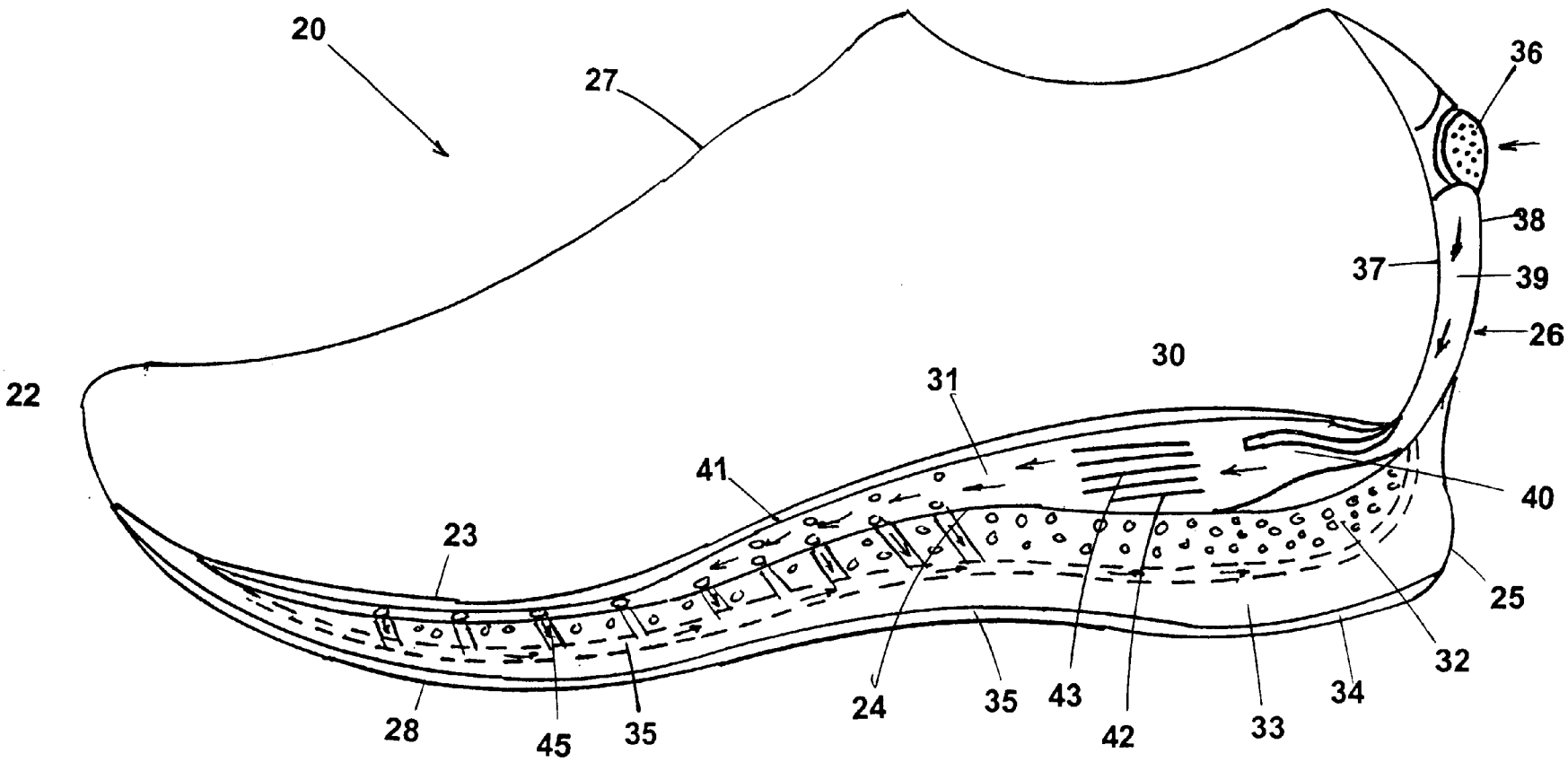
FIG. 1 is a side elevation view of the present invention.
Figure 2:
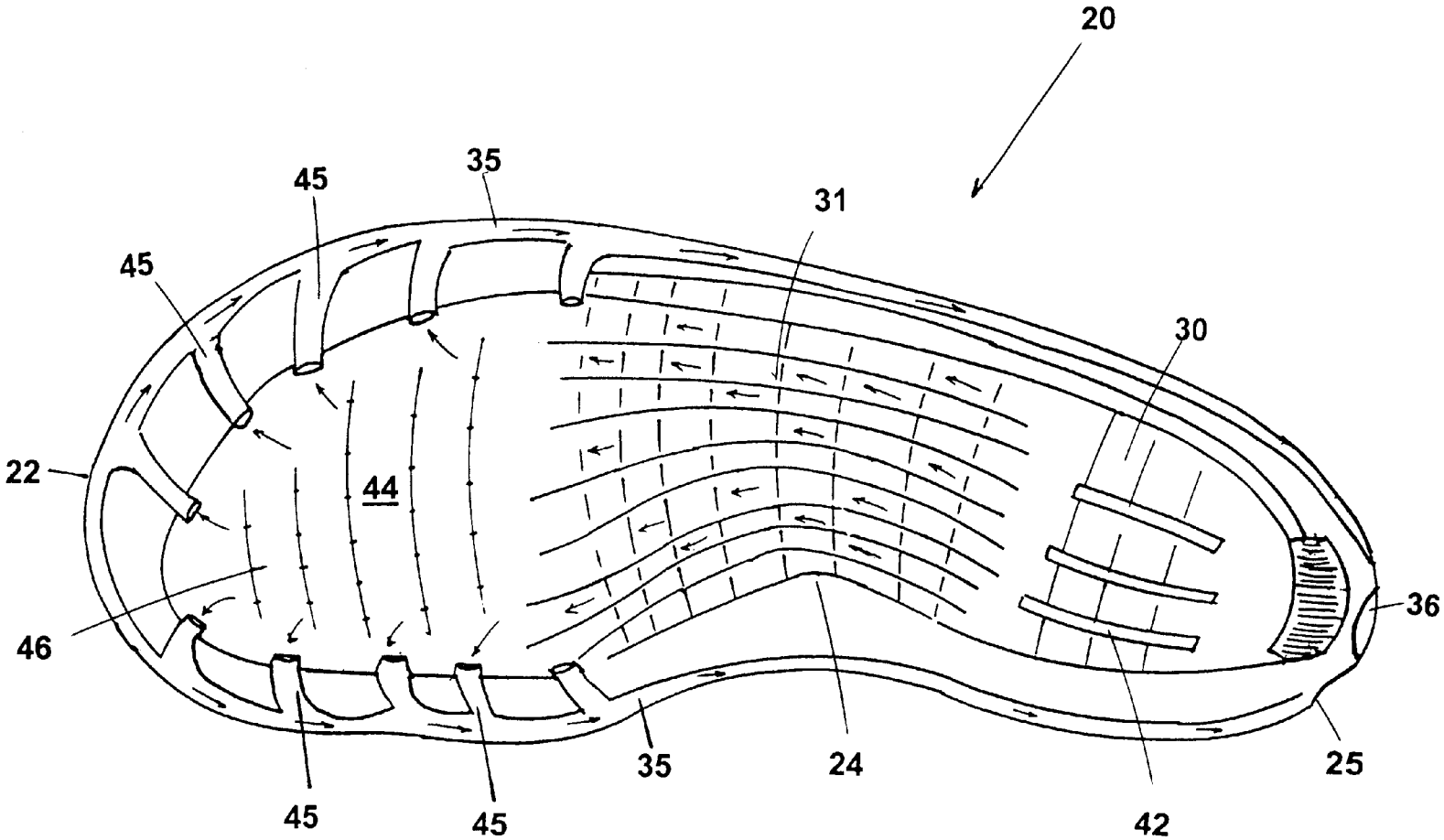
FIG. 2 is a top cross-sectional view of the invention's air flow system.

The foot is a very complex entity. The bones, ligaments, tendons, and muscles, together with leg muscles are a vital consideration in the design of the shoe. The present invention as shown in FIGS. 1–6, provides for a shoe that will not limit nor immobilize the foot. FIG. 1 shows the shoe 20 of the present invention being comprised of a toe section 22, metatarsal section 23, longitudinal arch section 24, heel section 25, back section 26, top section 27 and bottom section 28. Shoe 20 is designed to function with respect to anatomical, physiological and kinesiological considerations.

Figure 3:
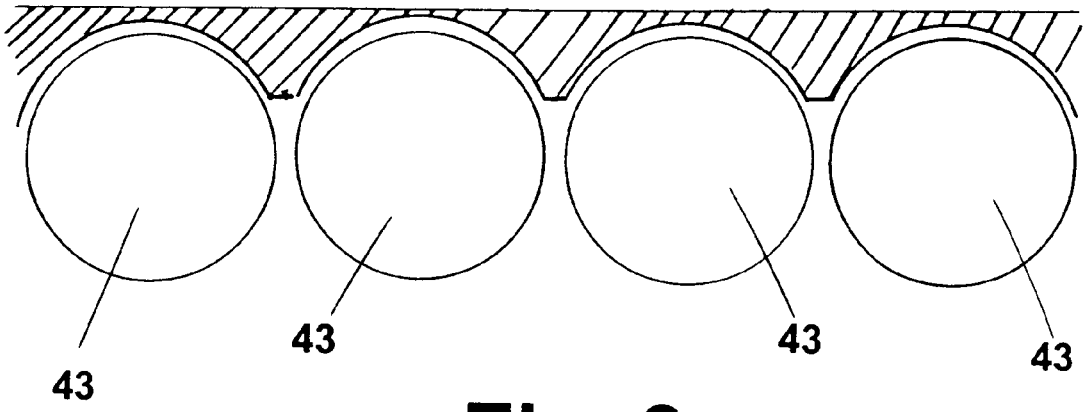
FIG. 3 is an end view of the multiple heart chambers.
Figure 4:
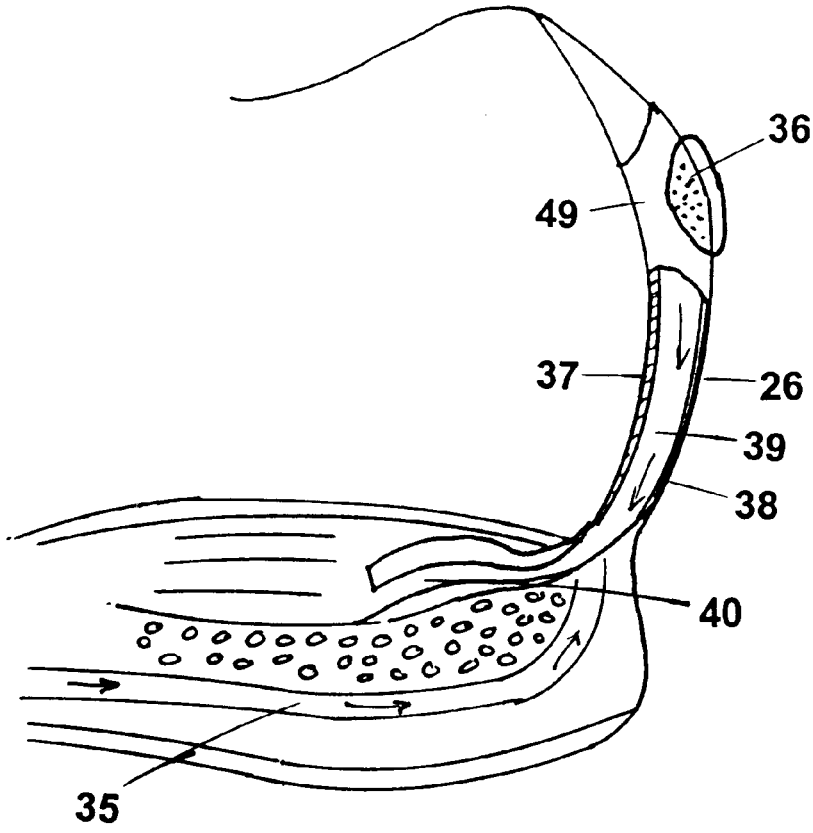
FIG. 4 is a side view of the sieve plate.
Figure 6:
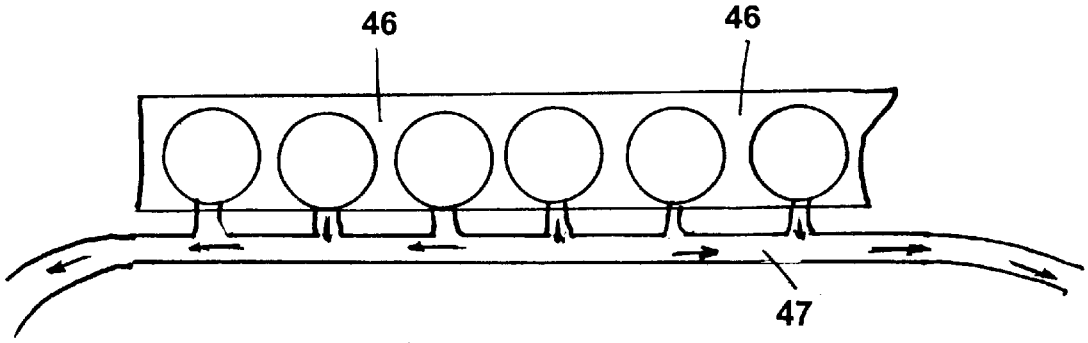
FIG. 6 is a top view of the anastamosing chamber of the shoe.

When a foot is in motion, the heel strikes the ground first, the body weight is then transmitted forward along the lateral periphery of the entire foot (as the longitudinal arch is in action) and finally passes to the metatarsal heads (in the transverse ridge) and to the toe rise whereby the cycle of muscular contraction and relaxation is resumed. When the heel of a person's foot is elevated, thereby transferring the body weight to the toe section, support is needed which is shown by the arrows in FIG. 2 which depict advancing air currents to be provided in the design of the shoe 20. The design of the present invention incorporates a heart pump 30, which is the main chamber for air, and upon the motion of the wearer's foot, air will be propelled forward. The pump 30 is raised slightly above and is the first to contact the wearer's heel and thereby the first to receive his/her weight. The air will pass through a plurality of arteries 31. As the air flows over the longitudinal arch section 24 it will allow for the customization as to size and shape of the individual's own arch. The present invention utilizes the foot in motion to provide the force to make the circulation work. The insole layer 41 which is the part of the shoe directly in contact with the person's foot provides for foot rest and is supported by the air flow through arteries 31. FIGS. 3 and 6 show how the heart chambers 43 and the superior and inferior parts of the insole coordinate to maintain the proper orientation of the arteries 31.

The evolutionary foot provides for an encapsulated system of fat for cushioning the muscles and nerves of the foot against the stress generated by walking and running. The present invention also utilizes encapsulated fat bodies 32, which are shown in FIG. 1 are more numerous in the heel section 25 where the greatest impact occurs. These fat bodies 32 can be voids or they can be filled with a gel or a resilient substance. The bottom section 28 will have a durable supporting medium 33 with a rubber base 34 for wear and abrasion resistance.

The main embodiment of the present invention is a shoe 20 with an on-demand air circulatory system, which encompasses an open and/or closed system. The system works on pressure gradients developed in function. The system uses a venous network of return veins 35 to return air to heart pump 30. It is to be appreciated that these veins 35 will be designed so as to be incorporated into the external surface and around the outer periphery of the shoe and also can be hidden from view or else designed as-part of the decorative look of the shoe. These return veins 35, like human veins, will have a unidirectional valve system (flap not shown) which will only allow flow towards the heart pump 30. The unidirectional valve system is critical for the maintenance of positive pressure gradient which would be necessary if a support stocking or hose were used in conjunction with the shoe. The pressure gradient developed by the person's heel striking the heart pump 30, as well as the foot being in motion, is sufficient to move the air towards the heart pump 30. It is to be appreciated that the veins 35 should be non-distensible. Distensible veins 35 have a tendency to create eddies which slow down the speed of blood and air in their systems. Distensible arteries have faster air flow in the center of the artery and slower flow at the sides which provides a measure of surface area increase and support. The design of the superior aspect of the insole and inferior aspect will limit the distension. This ensures flow and protection. Accordingly, It is important that the pressure of the returning air be maintained and not lost. According to the principles of laminar flow, the air closest to the wall meets with friction and therefore is slower than the air in the middle. It is also anticipated that these return veins 35 could also be connected to a support stocking to provide circulatory relief for the wearer.

Figure 5:
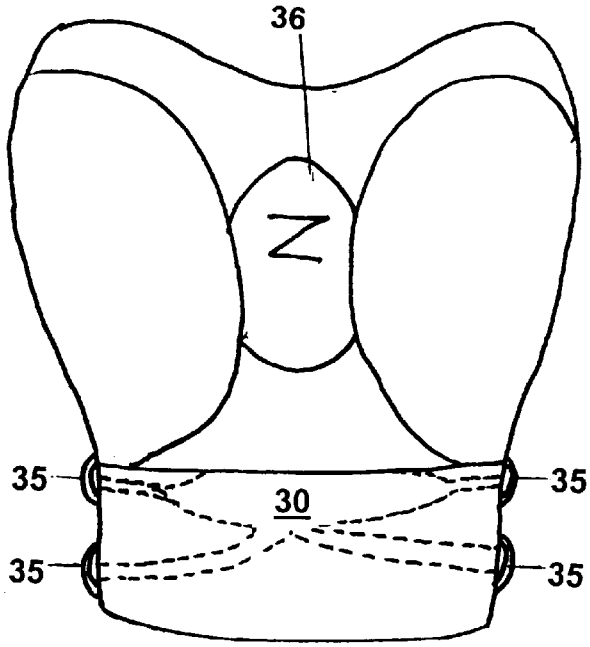
FIG. 5 is an elevational view of the shoe from the heel end.

The air supply to the heart pump 30 will be through a sieve plate 36 located at the back section 26. It is anticipated that sieve plate 36, as shown in FIG. 5, would be masked by the product logo or some other characteristic design. The logo may act as a filter or solid cap depending on function of the system. The external air supply will provide a cooling effect which will also help to reduce perspiration and eliminate odors. The back section 26 will be constructed from a pair of plastic support panels, an interior support panel 37 and an exterior support panel 38. A leather type covering would comprise the exterior coat of the shoe. The panels 37 and 38 are suggested to be made of plastic material because plastic is durable, non-deforming, light-weight and low in costs. The panels 37 and 38 are maintained in position by a strut 49 which serves to maintain the channel 39 therebetween. A balloon-like structure (not shown) could be employed within the channel 39 to help reduce any loss of air. Both panels 37 and 38 have their lower ends curved to define a valve 40. The exterior panel 38 is the lower curved portion and it is stationary by design. The upper curved section which is at the bottom of the interior panel 37 resembles an isthmus that can be depressed to therein shut-off the air channel 39, so that when the wearer's heel strikes down depressing the upper curved section, the air is closed to the heart pump 30. The air that is already in the heart pump 30 can only be propelled in one direction which is forward towards the toe of the shoe 10. A spring can also be employed beneath the lower curved section to aid the function of the valve 40. As this air is being propelled forward the heel is rising and the longitudinal arch is being formed. As the heel rises the upper curved section springs up and the positive pressure from the sieve plate 36 rushes air into the heart pump 30 to begin the process anew. In a closed system only the air in the return veins 35 is re-circulated. Basically the system is primed when the wearer starts walking. Once he feels that there is enough air, the sieve plate 36 can be closed off. This is a closed system. By leaving the sieve plate 36 open and rely on pressure gradients the user will create an open system.

The heart pump 30 includes multiple separators 42 which in addition to forming chambers 43 also provide for organized directional flow through the arteries 31. The pressure and speed is greatest coming out of the heart pump 30. As previously stated, the central air is the fastest and therefore advances the air closest to the wall of the artery is slowest 31. This is of importance because the slower moving air is providing the support for the foot in that position it finds itself at that particular instant in its motion. The chambers 43 are depressible and serve to direct the flow of air to the designated arteries 31. These chambers 43 ensure that the arteries 31 not only are supplied air but also the required propulsion. The arteries 31 that are closest to the heart pump 30 are the narrowest in diameter so as to provide the greatest air speed. They also are subjected to the greatest wall pressures. As the arch section 24 is approached it is preferred that the arteries 31 widen. The purpose for this is to slow the air motion down. This is achieved by increasing the diameter of the artery 31 to distend its wall. The distension is limited to protect the superior and inferior aspects of the insole from ballooning. The reason for this is to slow the air as it enters the anastamosing chamber 44. The chamber 44 has projections 46 on the underside of the superior insole which upon depression, creates canals 47 which serve to direct the remaining air to the portals 45. This chamber 44 has numerous portals 45 leading to veins 35. Upon beginning the activation of air into the arteries 31, the action of the muscles creates a longitudinal arch, and the person's weight is laterally displaced. Therefore it is desirable to increase the air support of the arch while lessening the support on the lateral side. The heart chambers 43 can be designed to allow more air on the medial side of the foot and perhaps less on the lateral side. It must be restated that the air system does not form the arch but rather allows for the foot of the person to develop its own form, shape and size arch. The present invention merely provides the support. This is a major inventive design concept from shoes which provide preformed arches, wherein each individual shoe had the same size and arch shape regardless of the individual characteristics of the wearer.

The present invention is set into motion by the wearer's heel striking down thereby propelling air forward to support the foot in the next position in time, ay which some of the air continues to be propelled forward to provide support for the foot at its next position. As the foot proceeds forward less support is required. Thereby, some of the air will be depressed through the inferior sole layer and supporting medium at which it deviates laterally and then re-enters the venous system. The design of the invention supports the foot at each particular time of its motion and also in the elimination or circulation of a portion of air.

While there has been and described what is at the present considered to be the preferred embodiment of the invention, it will be apparent to those skilled in the art that modifications and changes can be made therein without departing from the scope of the present invention as defined by the appended claims.

I claim:

1. A shoe air flow system comprising:

a shoe having a toe section, metatarsal section, longitudinal arch section, heel section, back section, bottom section and adapted to have a foot of a wearer disposed in the shoe for operating the air flow system;

a heart pump disposed in the heel section for actuating the main supply of air throughout the system;

a plurality of arteries for carrying air from the heart pump to the system, the plurality of arteries actuated by a pressure gradient caused by the downward thrust of the person's heel;

a plurality of venous non-distensible unidirectional veins disposed about the periphery of the shoe return the air rearward therefore to be discharged to the atmosphere;

an on-demand sieve plate is disposed on the back section as an access location for incoming air;

the back section includes a pair of support panels, an interior support panel and an exterior support panel, the panels defining an air channel there between for carrying air to the heart pump;

the lower ends of the panels are curved, the end of the exterior panel being stationary, the end of the interior panel having an isthmus type shape and positioned directly above the end of the exterior panel to create a valve, wherein the downward thrust of the wearer's heel causes the isthmus to close the valve and thereby shut the flow of air to the heart pump and subsequently cause the air in the heart pump to be propelled forward through the arteries.

2. The shoe air flow system according to claim 1, wherein encapsulated fat bodies are disposed in the heel section for shock absorption.

3. The shoe air flow system according to claim 2, wherein the fat bodies are voids.

4. The shoe air flow system according to claim 2, wherein the fat bodies are filled with a resilient gel substance.

5. The shoe air flow system according to claim 1, wherein the shoe is an athletic type shoe.

6. The shoe air flow system according to claim 1, wherein the shoe is a therapeutic shoe.

7. The shoe air flow system according to claim 1, wherein the bottom section is a durable rubber support medium for wear and abrasion resistance.

8. The shoe air flow system according to claim 1, wherein the system is a closed circulation having the veins returning air to the heart pump and not to the atmosphere.

9. The shoe air flow system according to claim 1, wherein the return veins are connected to a support stocking for providing circulatory relief for the wearer.

10. The shoe air flow system according to claim 1, wherein the sieve plate is a company logo.

11. The shoe air flow system according to claim 1, wherein the support panels are rigid plastic.

12. The shoe air flow system according to claim 1, wherein the channel contains a balloon-like structure to reduce any leakage of air.

13. The shoe air flow system according to claim 1, wherein a spring is disposed beneath the lower end of the exterior support panel for increased function of the valve.

14. The shoe air flow system according to claim 1, wherein the heart pump includes multiple separators which in addition to providing chambers also provides for organized directional flow through the arteries.

15. The shoe air flow system according to claim 1, wherein the portion of the arteries closest to the heart pump are the narrowest in diameter to provide the greatest air speed.

16. The shoe air flow system according to claim 1, wherein the arteries in the arch section are widened to slow the air motion down and provide a greater amount of support in that instant of time.

17. The shoe air flow system according to claim 1, wherein the arteries are designed to control the amount of air flow on the medial and lateral sides of the shoe, whereby air system provides support for the size, shape and form of the arch.

* * * * *